US012234988B1

(12) United States Patent
Dai et al.

(10) Patent No.: US 12,234,988 B1
(45) Date of Patent: Feb. 25, 2025

(54) FUEL NOZZLE FOR HYDROGEN-BASED FUEL OPERATION

(71) Applicant: RTX Corporation, Farmington, CT (US)

(72) Inventors: Zhongtao Dai, West Hartford, CT (US); Justin M. Locke, Tolland, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/626,821

(22) Filed: Apr. 4, 2024

(51) Int. Cl.

| | |
|---|---|
| ***F23R 3/14*** | (2006.01) |
| ***F23R 3/36*** | (2006.01) |
| *F23R 3/00* | (2006.01) |
| *F23R 3/28* | (2006.01) |

(52) U.S. Cl.
CPC ..... *F23R 3/14* (2013.01); *F23R 3/36* (2013.01); *F23R 3/002* (2013.01); *F23R 3/286* (2013.01)

(58) Field of Classification Search
CPC .... F23R 3/14; F23R 3/28; F23R 3/283; F23R 3/286; F23R 3/346; F23R 3/36
See application file for complete search history.

(56) References Cited

U.S. PATENT DOCUMENTS

| | | | | |
|---|---|---|---|---|
| 4,139,157 | A | 2/1979 | Simmons | |
| 4,562,698 | A | 1/1986 | Halvorsen et al. | |
| 4,977,740 | A | 12/1990 | Madden et al. | |
| 5,353,599 | A * | 10/1994 | Johnson | F23M 5/085 60/39.83 |
| 10,731,861 | B2 * | 8/2020 | Schlein | F23C 7/004 |
| 11,920,525 | B2 * | 3/2024 | Snyder | F02C 7/22 |
| 11,976,820 | B2 * | 5/2024 | Snyder | F23R 3/14 |
| 12,007,116 | B2 * | 6/2024 | Morenko | F23R 3/12 |
| 2006/0248898 | A1 * | 11/2006 | Buelow | F23R 3/14 60/776 |
| 2011/0067403 | A1 * | 3/2011 | Williams | F23R 3/286 60/742 |
| 2012/0047903 | A1 * | 3/2012 | Williams | F02C 9/34 60/746 |
| 2016/0209037 | A1 * | 7/2016 | Dai | F23R 3/12 |
| 2016/0209038 | A1 * | 7/2016 | Kopp-Vaughan | F23R 3/28 |

(Continued)

*Primary Examiner* — William H Rodriguez
(74) *Attorney, Agent, or Firm* — Kinney & Lange, P.A.

(57) ABSTRACT

A fuel nozzle for a gas turbine engine combustor includes a fuel nozzle assembly including an inflow tube disposed along and a nozzle axis, the inflow tube defining an inner air passage and a liquid swirler concentrically disposed about the inflow tube, the liquid swirler including a liquid swirler inner wall having a liquid swirler inner wall end portion angled radially outward from the nozzle axis, a liquid swirler outer wall having a liquid swirler outer wall end portion angled radially outward from the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis, an RAS outer wall having an end cap at a downstream-most position, and an annular gas passage defined therebetween. The end cap includes a radiused inner surface and a contoured outer surface, and the radiused inner surface is parallel to the RAS inner wall end portion.

20 Claims, 6 Drawing Sheets

(56) References Cited

U.S. PATENT DOCUMENTS

| | | | | |
|---|---|---|---|---|
| 2019/0257520 | A1* | 8/2019 | Tibbs | F23R 3/14 |
| 2022/0268213 | A1* | 8/2022 | Morenko | F23R 3/12 |
| 2024/0044293 | A1* | 2/2024 | Snyder | F02C 9/40 |
| 2024/0044496 | A1* | 2/2024 | Snyder | F23R 3/286 |

* cited by examiner

FUEL NOZZLE FOR HYDROGEN-BASED FUEL OPERATION

STATEMENT OF GOVERNMENT INTEREST

This invention was made with government support under Contract No. DE-FE0032171 awarded by United States Department of Energy. The government has certain rights in the invention.

BACKGROUND

The present disclosure relates to a gas turbine engine and, more particularly, to fuel nozzle passages for both a liquid and a gas.

Gas turbine engines, such as Industrial Gas Turbines utilized in power production, mechanical drives, and aero engines in commercial and military aircraft, include a compressor section to pressurize airflow, a combustor section to burn a hydrocarbon fuel in the presence of the pressurized air, and a turbine section to extract energy from the resultant combustion gases.

The combustor section includes multiple circumferentially distributed fuel nozzles that project into a forward section of a combustion chamber to supply fuel to mix with the pressurized airflow. The fuel nozzles may simultaneously utilize different types and combinations of fuel such as hydrogen, natural gas, Jet-A, diesel, JP8, and others. Further, to facilitate lower NOx emissions, water may be injected though the nozzle as well. Current fuel nozzle designs may, however, have durability issues due to potential flame holding and/or periodic flashback when hydrogen-based fuels are used. Accordingly, means for improving fuel nozzle cooling and mitigating flame holding and/or flashback are desirable.

SUMMARY

A fuel nozzle for a gas turbine engine combustor includes a fuel nozzle assembly including an inflow tube disposed along and a nozzle axis, the inflow tube defining an inner air passage and a liquid swirler concentrically disposed about the inflow tube, the liquid swirler including a liquid swirler inner wall having a liquid swirler inner wall end portion angled radially outward from the nozzle axis, a liquid swirler outer wall having a liquid swirler outer wall end portion angled radially outward from the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis, an RAS outer wall having an end cap at a downstream-most position, and an annular gas passage defined therebetween. The end cap includes a radiused inner surface and a contoured outer surface, and the radiused inner surface is parallel to the RAS inner wall end portion.

A gas turbine engine includes a combustor having a plurality of circumferentially distributed fuel nozzles, each of the plurality of fuel nozzles including a fuel nozzle assembly including an inflow tube disposed along and a nozzle axis, the inflow tube defining an inner air passage and a liquid swirler concentrically disposed about the inflow tube, the liquid swirler including a liquid swirler inner wall having a liquid swirler inner wall end portion angled radially outward from the nozzle axis, a liquid swirler outer wall having a liquid swirler outer wall end portion angled radially outward from the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis, an RAS outer wall having an end cap at a downstream-most position, and an annular gas passage defined therebetween. The end cap includes a radiused inner surface and a contoured outer surface, and the radiused inner surface is parallel to the RAS inner wall end portion.

Figure 1:
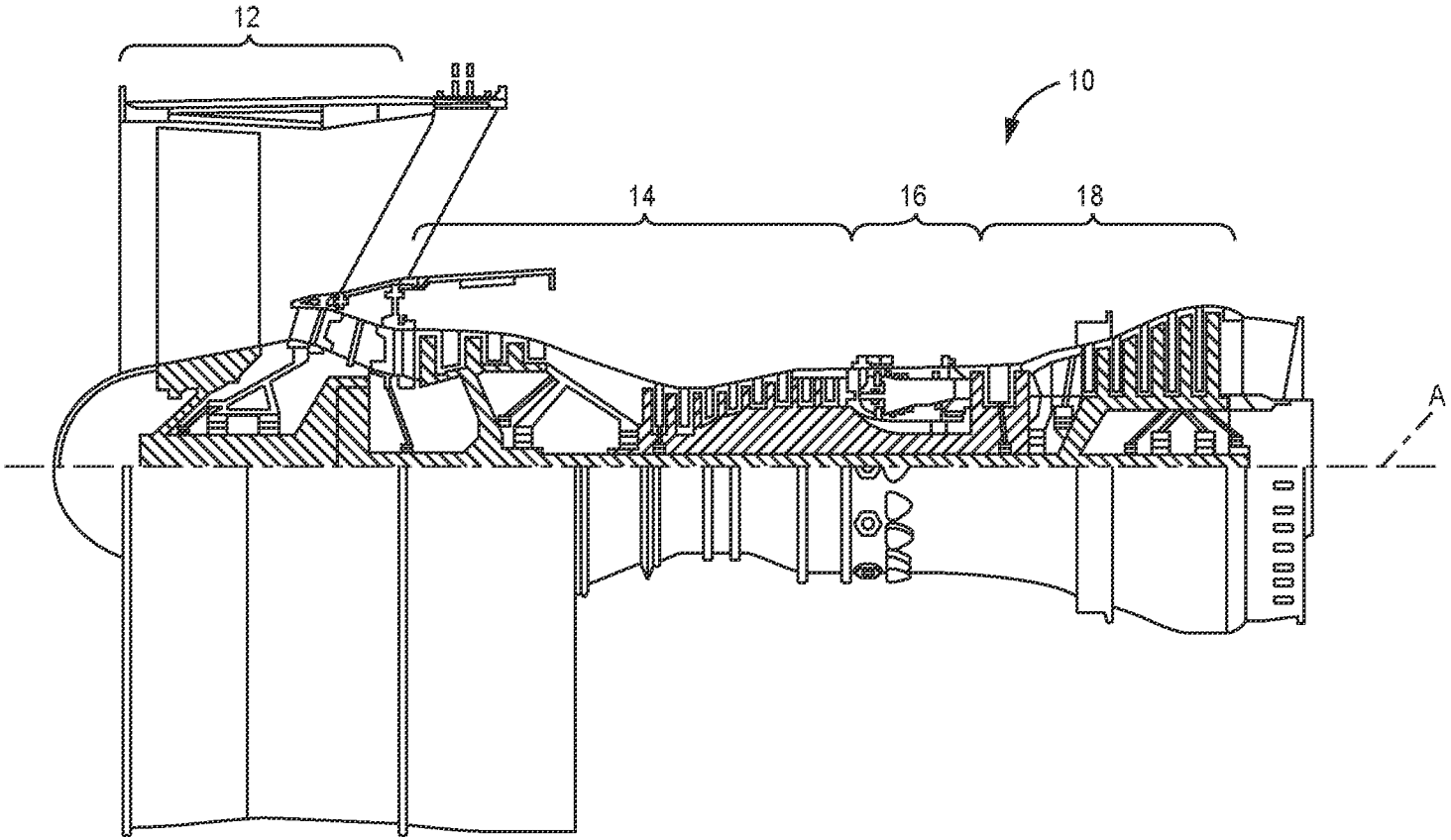
FIG. 1 is a simplified cross-sectional illustration of one example of a gas turbine engine.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

Figure 2:
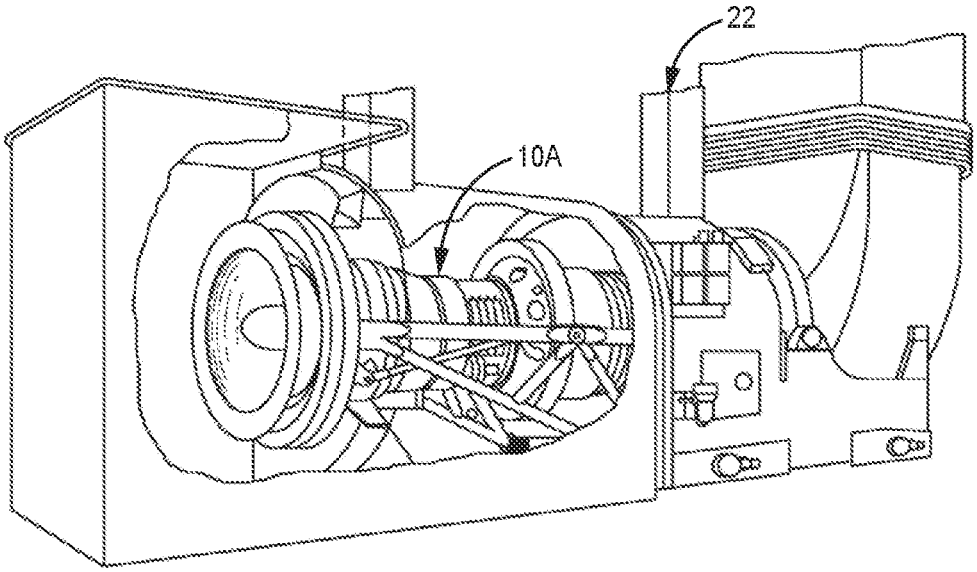
FIG. 2 is a simplified cross-sectional illustration of a second example of a gas turbine engine.

FIG. 1 schematically illustrates gas turbine engine 10. Gas turbine engine 10 is disclosed herein as a two-spool turbo fan that generally includes fan section 12, compressor section 14, combustor section 16 and turbine section 18. Fan section 12 drives air along a bypass flow path and into compressor section 14. Compressor section 14 drives air along a core flow path for compression and communication into combustor section 16, which then expands and directs the air through turbine section 18. Although depicted as a turbofan in the disclosed non-limiting embodiment, it should be understood that the concepts described herein are not limited to use with turbofans as the teachings may be applied to other types of turbine engines such as a low bypass augmented turbofan, turbojets, turboshafts, and three-spool (plus fan) turbofans with an intermediate spool. Still another engine architecture 10A can be located within enclosure 22 (FIG. 2) typical of an industrial gas turbine (IGT) in which there is no fan section, and hot gases that exit the low-pressure turbine flow into a power turbine to extract work.

Figure 3:
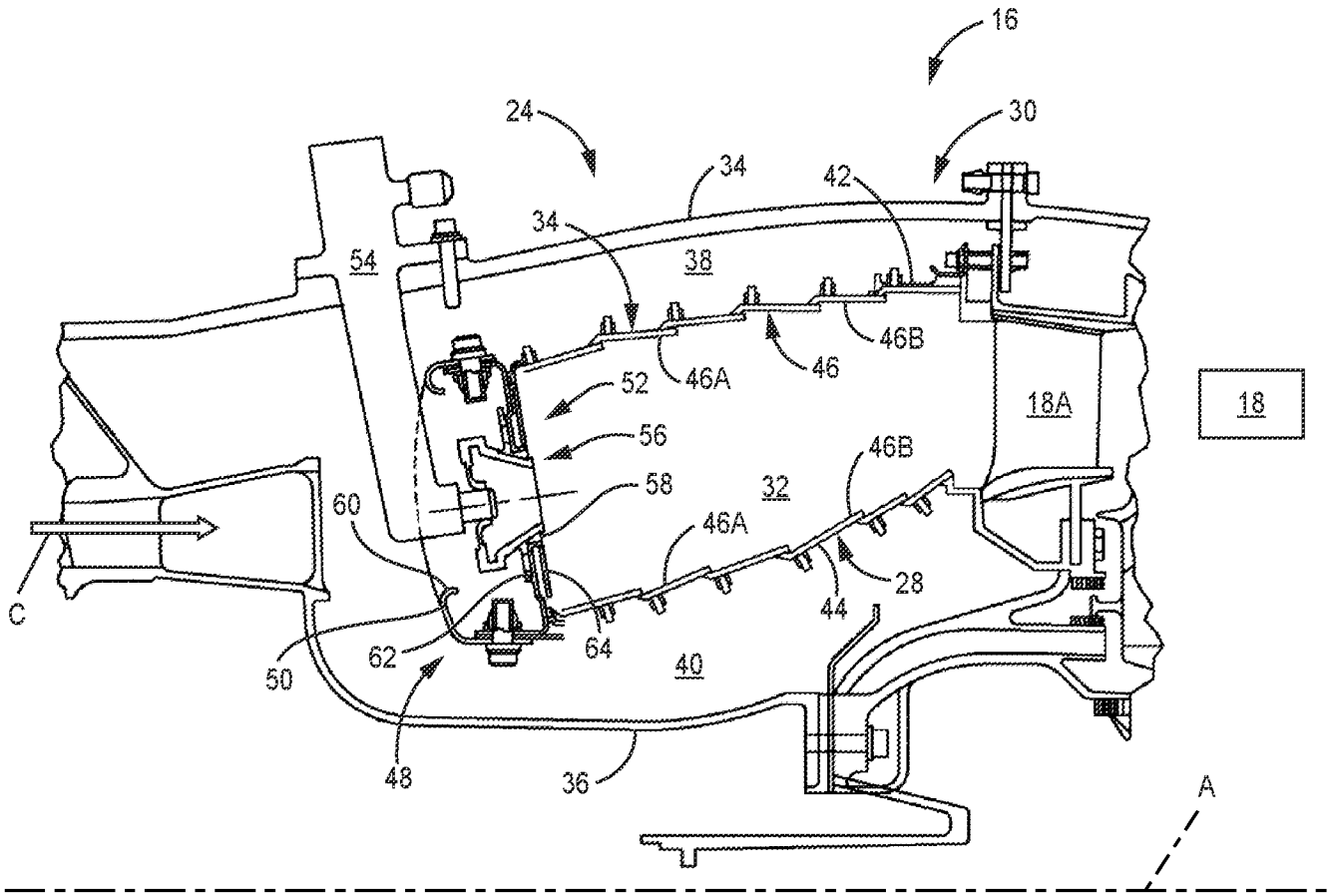
FIG. 3 is a simplified cross-sectional illustration of a combustor section of a gas turbine engine.

FIG. 3 schematically illustrates combustor section 16 (i.e., of gas turbine engines 10 and/or 10A). Combustor section 16 can include a combustor 24 with outer combustor wall assembly 26, inner combustor liner assembly 28 and diffuser case module 30. Outer combustor liner assembly 26 and inner combustor liner assembly 28 are spaced apart such that combustion chamber 32 is defined therebetween. Combustion chamber 32 may be generally annular in shape. Other combustors may include a number of individual cans.

Outer combustor liner assembly 26 is spaced radially inward from outer diffuser case 34 of diffuser case module 30 to define outer annular plenum 38. Inner combustor liner assembly 28 is spaced radially outward from inner diffuser case 36 of diffuser case module 30 to define inner annular plenum 40. It should be understood that although a particular combustor is illustrated, other combustor types with various combustor liner arrangements will also benefit herefrom. It should be further understood that the disclosed cooling flow paths are but an illustrated embodiment and should not be limited only thereto.

Combustor liner assemblies 26, 28 contain combustion products for direction toward turbine section 18. Each combustor liner assembly 26, 28 generally includes a respective support shell 42, 44 which supports one or more liner panels 46 mounted to a hot side of the respective support shell 42, 44. Each liner panel 46 may be generally rectilinear and manufactured of, for example, a nickel based super alloy, ceramic or other temperature resistant material and are arranged to form a liner array. In one disclosed non-limiting embodiment, the liner array includes a multiple of forward liner panels 46A and a multiple of aft liner panels 46B that are circumferentially staggered to line the hot side of outer shell 42. A multiple of forward liner panels 46A and a multiple of aft liner panels 46B are circumferentially staggered to line hot side of inner shell 44.

Combustor 24 further includes forward assembly 48 immediately downstream of compressor section 14 to receive compressed airflow therefrom. Forward assembly 48 generally includes annular hood 50 and bulkhead assembly 52 which locate a multiple of fuel nozzles 54 (one shown) and a multiple of guide swirlers 56 (one shown). Each guide swirler 56 is mounted within a respective opening 58 of bulkhead assembly 52 to be circumferentially aligned with one of a multiple of annular hood ports 60. Each bulkhead assembly 52 generally includes bulkhead support shell 62 secured to combustor liner assemblies 26, 28, and a multiple of circumferentially distributed bulkhead liner panels 64 secured to bulkhead support shell 62.

Annular hood 50 extends radially between, and is secured to, the forwardmost ends of combustor liner assemblies 26, 28. Annular hood 50 forms the multiple of circumferentially distributed hood ports 60 that accommodate a respective fuel nozzle 54 and introduce air into the forward end of combustion chamber 32. Each fuel nozzle 54 may be secured the diffuser case module 30 and project through one of the hood ports 60 and the respective guide swirler 56.

Forward assembly 48 introduces core combustion air into the forward section of combustion chamber 32 while the remainder enters outer annular plenum 38 and inner annular plenum 40. The multiple of fuel nozzles 54 and adjacent structure generate a blended fuel-air mixture that supports stable combustion in combustion chamber 32. Opposite forward assembly 48, outer and inner support shells 42, 44 are mounted to a first row of Nozzle Guide Vanes (NGVs) 18A. NGVs 18A are static engine components which direct the combustion gases onto the turbine blades in turbine section 18 to facilitate the conversion of pressure energy into kinetic energy. The combustion gases are also accelerated by the NGVs 18A because of their convergent shape and are typically given a "spin" or a "swirl" in the direction of turbine rotation.

Figure 4:
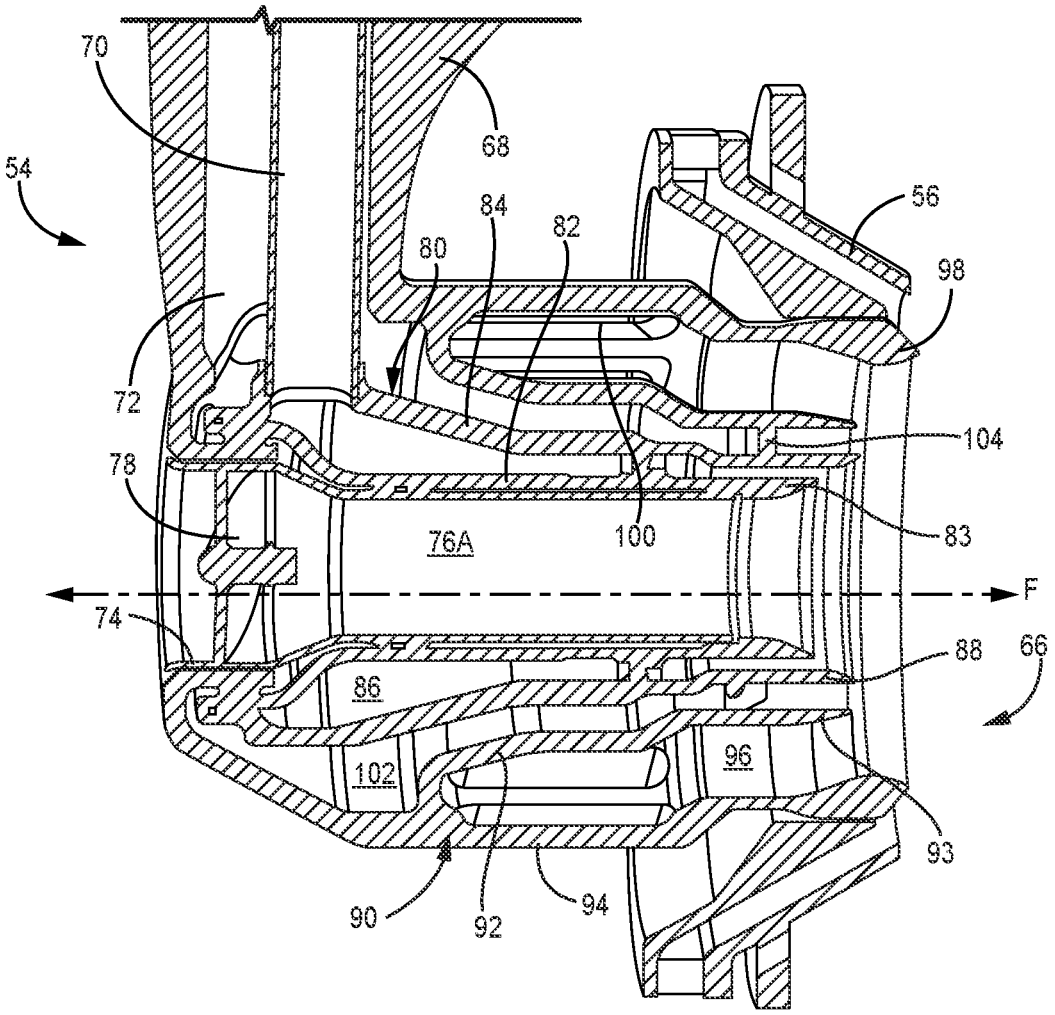
FIG. 4 is a simplified cross-sectional illustration of a portion of a fuel injector for a gas turbine engine combustor section.

FIG. 4 is a schematic cross-sectional illustration of a portion of fuel injector 54 including fuel nozzle assembly 66. Fuel injector 54 includes fluid passages within support housing 68 which are in fluid communication with fuel nozzle assembly 66 as is discussed in greater detail below. More specifically, tube 70 is configured to provide a liquid (e.g., liquid fuel or water) to fuel nozzle assembly 66, and gas passage 72 is configured to supply a gaseous fuel, or "fuel gas" (e.g., hydrogen and/or natural gas) to fuel nozzle assembly 66. Gas passage 72 can function as a heat shield to prevent coking when the fuel used is a liquid fuel. In one example, the fuel gas can be hydrogen based, such as pure hydrogen or a blend of hydrogen with a gaseous hydrocarbon, such as natural gas or propane. In such example, water can be the liquid injected via tube 70 to help reduce NOx emissions. Fuel nozzle assembly 66 can be partially received by guide swirler 56.

Fuel nozzle assembly 66 generally extends along and is disposed about nozzle axis F. Beginning radially inward, inflow tube 74 defines inner gas passage 76 of fuel nozzle assembly 66. Axial swirler 78 with helical vanes is disposed within inner gas passage 76 to swirl incoming air. Liquid swirler 80 is concentrically disposed about inflow tube 74 and includes inner wall 82 and outer wall 84, and annular liquid passage 86 defined therebetween. Annular liquid passage 86 receives liquid from tube 70. Inner wall 82 includes flared end portion (or edge) 83 which is angled away, in the upstream to downstream direction, from axis F to allow at least a portion of the air flow exiting inner gas passage 76 to diffuse radially outward. End portion (or edge) 88 of outer wall 84 can be angled toward axis F to direct the flow of liquid radially inward. Radial air swirler 90 is concentrically disposed about liquid swirler 80 and includes inner wall 92, outer wall 94, and annular air passage 96 defined therebetween. Inner wall 92 includes end portion (or edge) 93 which is angled toward, in the upstream to downstream direction, axis F. Outer wall 94 includes end cap 98 which can be similarly angled toward axis F such that end portion 93 and end cap 98 help direct the flow of air exiting annular air passage 96 radially inward. Air enters annular air passage 96 via slots 100 within outer wall 94. Annular fuel gas passage 102 is defined between outer wall 84 of liquid swirler 80 and inner wall 92 of radial air swirler 90. Annular fuel gas passage 102 receives fuel gas from gas passage 72. Fuel swirlers 104 can be disposed within fuel gas passage 102 to swirl the flow of fuel gas.

Figure 5A:
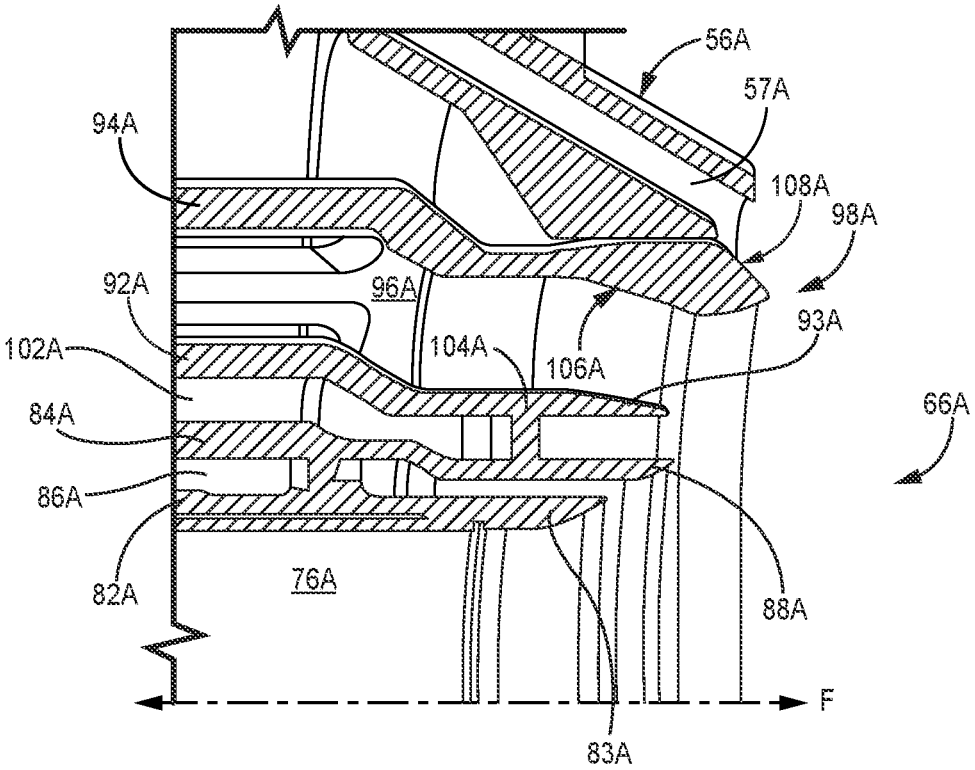
FIG. 5A is an enlarged cross-sectional view of a portion of a first fuel nozzle assembly.
Figure 5B:
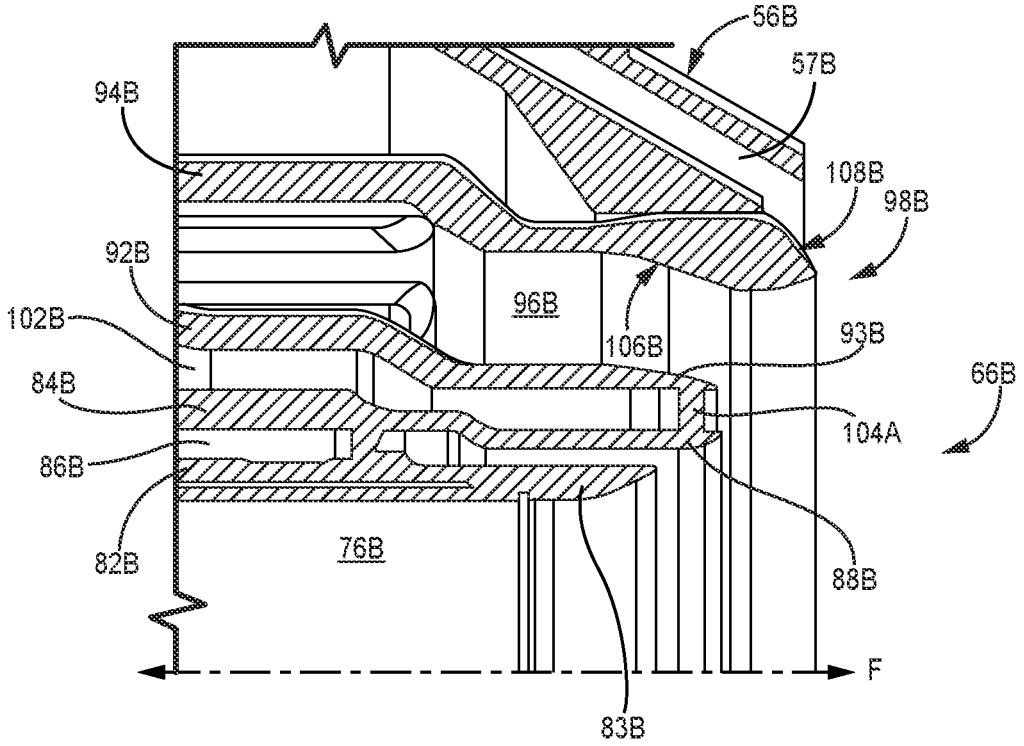
FIG. 5B is an enlarged cross-sectional view of a portion of an alternative fuel nozzle assembly.

FIGS. 5A and 5B are enlarged cross-sectional views of portions of alternative fuel nozzle assemblies 66A and 66B. FIGS. 5A and 5B are discussed with continued reference to FIG. 4.

Referring first to FIG. 5A, fuel nozzle assembly 66A is substantially similar to fuel nozzle assembly 66 as shown in FIG. 4. Flared end portion 83A of inner wall 82A is angled similarly to end portion 88A of outer wall 84A which permits the outward radial expansion of air flow exiting inner gas passage 76A, as noted above, and further allows for filming of the liquid (e.g., water or liquid fuel) exiting annular liquid passage 86A. This not only provides sheath flow to protect flared end portion 83A, but also improves liquid atomization and mixing with other gases, including air flow from inner gas passage 76A and fuel gas exiting annular fuel gas passage 102A. The angling of end portions 83A and 88A is thus an improvement over existing fuel nozzle assembly designs with sharp angles/turns, as they are prone to "flame holding." This is especially true with hydrogen-based fuels. Fuel nozzle assembly further includes end cap 98A of outer wall 94A having radiused inner surface 106A and contoured outer surface 108A. Radiused inner surface 106A is angled slightly radially inward similar to end portion 93A of inner wall 92A such that the downstream-most section of annular air passage 96A is generally parallel and radially inwardly disposed. This eliminates relatively sharper turns found in other non-radiused designs and better urges flames away from fuel nozzle assembly 66A. Contoured outer surface 108A is also generally aligned with annular air passage 57A within guide swirler 56A. As such, fuel gas exiting annular fuel gas passage 102A is immediately impinged upon by air flows exiting inner gas passage 76A and annular air passage 96A, which, along with the alignment of contoured outer surface 108A with annular air passage 57A, minimizes air flow separation zones to help prevent flame holding against fuel nozzle assembly 66A surfaces/edges. Finally, fuel nozzle assembly 66A can include recessed fuel swirlers 104A. In the embodiment shown, "recessed" generally refers to the downstream axial position of fuel swirlers 104A relative to end portions 88A and 93A such that fuel swirlers 104A do not radially overlap with end portions 88A and 93A. Such placement helps to prevent flame holding on fuel swirlers 104A.

Referring to FIG. 5B, fuel nozzle assembly 66B is substantially similar to fuel nozzle assembly 66A, having end portion 83B of inner wall 82B and end portion 88B of outer wall 84B which are angled away from axis F to allow outward radial expansion of air flow exiting inner gas passage 76B, which imparts all the benefits noted above with respect to fuel nozzle 66A, including improved atomization of water or liquid fuel exiting annular liquid passage 86B. End cap 98B of outer wall 94B has a radiused inner surface 106B and contoured outer surface 108B. Radiused inner surface 106B is angled similarly to end portion 93B of inner wall 92B such that air flow through annular air passage 96B exits in a radially inward direction. Contoured outer surface 108B is generally aligned with annular air passage 57B of guide swirler 56B. Fuel nozzle assembly 66B differs from fuel nozzle assembly 66A in that fuel swirlers 104B are not recessed, that is, fuel swirlers 104B are disposed further downstream within annular fuel gas passage 102B and radially overlap with end portions 88B and 93B.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

Discussion of Possible Embodiments

The following are non-exclusive descriptions of possible embodiments of the present invention.

A fuel nozzle for a gas turbine engine combustor includes a fuel nozzle assembly including an inflow tube disposed along and a nozzle axis, the inflow tube defining an inner air passage and a liquid swirler concentrically disposed about the inflow tube, the liquid swirler including a liquid swirler inner wall having a liquid swirler inner wall end portion angled radially outward from the nozzle axis, a liquid swirler outer wall having a liquid swirler outer wall end portion angled radially outward from the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis, an RAS outer wall having an end cap at a downstream-most position, and an annular gas passage defined therebetween. The end cap includes a radiused inner surface and a contoured outer surface, and the radiused inner surface is parallel to the RAS inner wall end portion.

The fuel nozzle of the preceding paragraph can optionally include, additionally and/or alternatively, any one or more of the following features, configurations and/or additional components:

The above fuel nozzle can further include a guide swirler disposed concentrically about the RAS outer wall, the guide swirler comprising an annular air passage angled radially inward toward the nozzle axis.

In any of the above fuel nozzles, the contoured outer surface of the end cap can be aligned with the annular air passage of the guide swirler.

In any of the above fuel nozzles, the liquid swirler outer wall and the RAS inner wall can define an annular fuel gas passage therebetween.

Any of the above fuel nozzles can further include a plurality of fuel swirlers disposed within the annular fuel gas passage upstream of each of the liquid swirler outer wall end portion and the RAS inner wall end portion.

Any of the above fuel nozzles can further include a plurality of fuel swirlers disposed within the annular fuel gas passage such that each of the plurality of fuel swirlers radially overlaps with each of the liquid swirler outer wall end portion and the RAS inner wall end portion.

Any of the above fuel nozzles can further include an axial swirler disposed within the inner gas passage.

In any of the above fuel nozzles, a plurality of slots can extend through the RAS outer wall for allowing air to pass therethrough into the annular gas passage.

Any of the above fuel nozzles can further include a tube extending through a housing of the fuel nozzle, the tube being in fluid communication with the annular liquid passage.

Any of the above fuel nozzles can further include a gas passage extending through a housing of the fuel nozzle, the gas passage being in fluid communication with the annular fuel gas passage.

A gas turbine engine includes a combustor having a plurality of circumferentially distributed fuel nozzles, each of the plurality of fuel nozzles including a fuel nozzle assembly including an inflow tube disposed along and a nozzle axis, the inflow tube defining an inner air passage and a liquid swirler concentrically disposed about the inflow tube, the liquid swirler including a liquid swirler inner wall having a liquid swirler inner wall end portion angled radially outward from the nozzle axis, a liquid swirler outer wall having a liquid swirler outer wall end portion angled radially outward from the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis, an RAS outer wall having an end cap at a downstream-most position, and an annular gas passage defined therebetween. The end cap includes a radiused inner surface and a contoured outer surface, and the radiused inner surface is parallel to the RAS inner wall end portion.

The gas turbine engine of the preceding paragraph can optionally include, additionally and/or alternatively, any one or more of the following features, configurations and/or additional components:

The above gas turbine engine can further include a guide swirler disposed concentrically about the RAS outer wall, the guide swirler comprising an annular air passage angled radially inward toward the nozzle axis.

In any of the above gas turbine engines, the contoured outer surface of the end cap can be aligned with the annular air passage of the guide swirler.

In any of the above gas turbine engines, the liquid swirler outer wall and the RAS inner wall can define an annular fuel gas passage therebetween.

Any of the above gas turbine engines can further include a plurality of fuel swirlers disposed within the annular fuel gas passage upstream of each of the liquid swirler outer wall end portion and the RAS inner wall end portion.

Any of the above gas turbine engines can further include a plurality of fuel swirlers disposed within the annular fuel gas passage such that each of the plurality of fuel swirlers radially overlaps with each of the liquid swirler outer wall end portion and the RAS inner wall end portion.

Any of the above gas turbine engines can further include an axial swirler disposed within inner gas passage.

In any of the above gas turbine engines, a plurality of slots can extend through the RAS outer wall for allowing air to pass therethrough into the annular gas passage.

Any of the above gas turbine engines can further include a tube extending through a housing of the fuel nozzle, the tube being in fluid communication with the annular liquid passage.

Any of the above gas turbine engines can further include a gas passage extending through a housing of the fuel nozzle, the gas passage being in fluid communication with the annular fuel gas passage.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fuel nozzle for a gas turbine engine combustor, the fuel nozzle comprising:

a fuel nozzle assembly comprising:

an inflow tube disposed along and a nozzle axis, the inflow tube defining an inner air passage;

a liquid swirler concentrically disposed about the inflow tube, the liquid swirler comprising:

a liquid swirler inner wall having a liquid swirler inner wall end portion angled radially outward from the nozzle axis;

a liquid swirler outer wall having a liquid swirler outer wall end portion angled radially outward from the nozzle axis; and an annular liquid passage defined therebetween; and a radial air swirler (RAS) concentrically disposed about the liquid swirler outer wall, the RAS comprising:

an RAS inner wall having an RAS inner wall end portion angled radially inward toward the nozzle axis;

an RAS outer wall having an end cap at a downstream-most position; and an annular gas passage defined therebetween, wherein the end cap comprises a radiused inner surface and a contoured outer surface; and wherein the radiused inner surface is parallel to the RAS inner wall end portion.

2. The fuel nozzle of claim 1 and further comprising: a guide swirler disposed concentrically about the RAS outer wall, the guide swirler comprising an annular air passage angled radially inward toward the nozzle axis.

3. The fuel nozzle of claim 2, wherein the contoured outer surface of the end cap is aligned with the annular air passage of the guide swirler.

4. The fuel nozzle of claim 2, wherein the liquid swirler outer wall and the RAS inner wall define an annular fuel gas passage therebetween.

5. The fuel nozzle of claim 4 and further comprising: a plurality of fuel swirlers disposed within the annular fuel gas passage upstream of each of the liquid swirler outer wall end portion and the RAS inner wall end portion.

6. The fuel nozzle of claim 4 and further comprising: a plurality of fuel swirlers disposed within the annular fuel gas passage such that each of the plurality of fuel swirlers radially overlaps with each of the liquid swirler outer wall end portion and the RAS inner wall end portion.

7. The fuel nozzle of claim 2 and further comprising: an axial swirler disposed within the inner gas passage.

8. The fuel nozzle of claim 2, wherein a plurality of slots extend through the RAS outer wall for allowing air to pass therethrough into the annular gas passage.

9. The fuel nozzle of claim 2 and further comprising: a tube extending through a housing of the fuel nozzle, the tube being in fluid communication with the annular liquid passage.

10. The fuel nozzle of claim 2 and further comprising: a gas passage extending through a housing of the fuel nozzle, the gas passage being in fluid communication with the annular fuel gas passage.

11. A gas turbine engine comprising:

a combustor having a plurality of circumferentially distributed fuel nozzles, each of the plurality of fuel nozzles comprising:

a fuel nozzle assembly comprising:

an inflow tube disposed along and a nozzle axis, the inflow tube defining an inner air passage;

a liquid swirler concentrically disposed about the inflow tube, the liquid swirler comprising:

a liquid swirler inner wall having a liquid swirler inner wall end portion angled radially outward from the nozzle axis;

a liquid swirler outer wall having a liquid swirler outer wall end portion angled radially outward from the nozzle axis; and an annular liquid passage defined therebetween; and a radial air swirler (RAS) concentrically disposed about the liquid swirler outer wall, the RAS comprising:

an RAS inner wall having an RAS inner wall end portion angled radially inward toward the nozzle axis;

an RAS outer wall having an end cap at a downstream-most position; and an annular gas passage defined therebetween, wherein the end cap comprises a radiused inner surface and a contoured outer surface; and wherein the radiused inner surface is parallel to the RAS inner wall end portion.

12. The gas turbine engine of claim 11 and further comprising: a guide swirler disposed concentrically about the RAS outer wall, the guide swirler comprising an annular air passage angled radially inward toward the nozzle axis.

13. The gas turbine engine of claim 12, wherein the contoured outer surface of the end cap is aligned with the annular air passage of the guide swirler.

14. The gas turbine engine of claim 12, wherein the liquid swirler outer wall and the RAS inner wall define an annular fuel gas passage therebetween.

15. The gas turbine engine of claim 14 and further comprising: a plurality of fuel swirlers disposed within the annular fuel gas passage upstream of each of the liquid swirler outer wall end portion and the RAS inner wall end portion.

16. The gas turbine engine of claim 14 and further comprising: a plurality of fuel swirlers disposed within the annular fuel gas passage such that each of the plurality of fuel swirlers radially overlaps with each of the liquid swirler outer wall end portion and the RAS inner wall end portion.

17. The gas turbine engine of claim 12 and further comprising: an axial swirler disposed within inner gas passage.

18. The gas turbine engine of claim 12, wherein a plurality of slots extend through the RAS outer wall for allowing air to pass therethrough into the annular gas passage.

19. The gas turbine engine of claim 12 and further comprising: a tube extending through a housing of the fuel nozzle, the tube being in fluid communication with the annular liquid passage.

20. The gas turbine engine of claim 12 and further comprising: a gas passage extending through a housing of the fuel nozzle, the gas passage being in fluid communication with the annular fuel gas passage.

* * * * *